US006535703B2

(12) United States Patent
Yamamoto et al.

(10) Patent No.: US 6,535,703 B2
(45) Date of Patent: Mar. 18, 2003

(54) ELECTROPHOTOGRAPHIC IMAGE PRINTING APPARATUS USING LIQUID DEVELOPER

(75) Inventors: Noriko Yamamoto, Kanagawa (JP); Kenichi Takahara, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/950,765

(22) Filed: Sep. 13, 2001

(65) Prior Publication Data

US 2002/0031367 A1 Mar. 14, 2002

(30) Foreign Application Priority Data

Sep. 13, 2000 (JP) ..... 2000-278504
Sep. 27, 2000 (JP) ..... 2000-293617

(51) Int. Cl.[7] ..... G03G 21/20
(52) U.S. Cl. ..... 399/93; 399/98; 399/250
(58) Field of Search ..... 95/273, 274; 399/93, 399/98, 250, 251

(56) References Cited

U.S. PATENT DOCUMENTS 4,733,272 A 3/1988 Howe et al.
5,905,928 A * 5/1999 Shin ..... 399/250
6,284,020 B1 * 9/2001 Mizuno et al. ..... 95/26
6,289,192 B1 9/2001 Nukada et al.

* cited by examiner

*Primary Examiner*—Hoang Ngo
(74) *Attorney, Agent, or Firm*—Oblon, Spivak, McClelland, Maier & Neustadt, P.C.

(57) ABSTRACT

Disclosed is an electrophotographic printing apparatus for printing an image on a print medium with use of a liquid developer which contains a liquid carrier and a toner being dispersed in the liquid carrier. It has an image printing system comprising an imaging surface on which a toner image is formed from the liquid developer, and transferring the toner image from the imaging surface to the print medium, and an air treatment system having a cleaning member. The cleaning member has a holding member having a plurality of passages in rows, and a particulate material which is capable of absorbing or adsorbing vapor of the liquid carrier and which is held in the passage with room for the particulate material to move in the passages.

22 Claims, 7 Drawing Sheets

ELECTROPHOTOGRAPHIC IMAGE PRINTING APPARATUS USING LIQUID DEVELOPER

BACKGROUND OF THE INVENTION

1. Field of the Invention

The present invention relates to an electrophotographic image printing apparatus for forming an image using a liquid developer by an electrophotographic technology. More particularly, the present invention relates to an electrophotographic printing apparatus equipped with an exhaust treating apparatus for treating an exhaust containing a vapor of a carrier solvent generated in an apparatus by use of a liquid developer.

2. Related Art

From the standpoint of the developer used, electrophotographic technologies are classified into those of dry development using a solid developer and those of wet (liquid) development using a liquid developer. In the conventional electrophotographic technologies, wet development is believed to be practically disadvantageous because of some substantial problems, and consequently, the field of image formation by electrophotographic technologies has been long occupied substantially by dry development.

However, electrophotography of wet development has also an advantage which can not be realized by dry development. Examples include that: since an extremely fine toner of sub-micron size can be used, high image quality can be realized; since sufficient image concentration is obtained with a small amount of toner, an economical advantage is obtained and texture corresponding to offset printing or other like printing can be realized; since a toner can be fixed to paper at relatively lower temperature, energy saving and high speed output can be realized; and the like. Based on these facts, the value of electrophotography based on wet development has been reviewed and development is in progress aiming at practical use.

Substantial problems of an electrophotographic technology based on wet development are concerned with vaporization of an organic solvent which is contained as a carrier in a developer and treatments thereof, and one of them is that an exhaust containing the vaporized organic solvent must be necessarily subjected to treatment for removal of the organic solvent, before discharging the exhaust out of the printing apparatus. This problem is regarded recently as important from the standpoints of environmental pollution and health. Moreover, even in use of safe petroleum-based synthetic solvents exhibiting no carcinogenicity (Isoper manufactured by Exson, and the like) as a carrier, other problems such as uncomfortable odor of a solvent occur. Therefore, it is desirable that a solvent in the exhaust is removed before discharge as completely as possible.

In order to solve this problem, for example, Japanese Patent No. 2892643 and U.S. Pat. No. 5,737,674 disclose electrophotography systems in which an exhaust containing a solvent vapor is liquefied and removed, and the concentration of vaporized solvent in the exhaust in U.S. Pat. No. 5,737,674 is lowered by passing the exhaust through a cooling liquid to cool and condense the vapor of solvent.

However, in the case of removing the vaporized solvent from the exhaust by the above system, liquefaction does not progress sufficiently if the contact area of cooling liquid with the exhaust is small and the contact time thereof is short. Therefore, the apparatus should be so constituted, for assured removal of a solvent, that the contact area and the contact time with the exhaust are sufficiently secured. Thus, a certain volume is necessary. Moreover, measures for controlling the treating conditions such as temperature and the like are also required to be installed. Therefore, the whole dimension of an image printing apparatus has to be increased. In U.S. Pat. No. 4,733,272, it is disclosed that the exhaust subjected to treatment to condense the vaporized solvent through a solvent condenser is then passed through a filter containing activated carbon to still remove the vaporized solvent.

It is not only in the above method of the liquefaction mode but also in general methods that securing the contact area with an exhaust is necessary for assured removal of a vaporized solvent from the exhaust, and it is important for size reduction of an image printing apparatus to constitute the apparatus so as to realize sure purification of an exhaust in a space that is as small as possible.

SUMMARY OF THE INVENTION

An object of the present invention is to provide an electrophotographic printing apparatus equipped with an exhaust cleaning device which is advantageous for size reduction of the whole apparatus and which can purify an exhaust assuredly.

Another object of the present invention is to provide an electrophotographic printing apparatus equipped with an exhaust cleaning device which can be easily exchanged and which provides tight sealing for exhaust.

Still another object of the present invention is to provide an electrophotographic printing apparatus having an exhaust cleaning device which can manifest efficient purification function sufficiently and can purify an exhaust assuredly.

In order to achieve the above objects, an electrophotographic printing apparatus for printing an image on a print medium with use of a liquid developer which contains a liquid carrier and a toner being dispersed in the liquid carrier, according to an aspect of the present invention, comprises: an image printing system comprising an imaging surface for forming a toner image from the liquid developer, and transferring the toner image from the imaging surface to the print medium; and an air treatment system having a cleaning member which comprises: a holding member having a plurality of passages in rows; and a particulate material which is capable of absorbing or adsorbing vapor of the liquid carrier and which is held in the plurality of passages.

According to another aspect of the present invention, an electrophotographic printing apparatus for printing an image on a print medium with use of a liquid developer which contains a liquid carrier and a toner being dispersed in the liquid carrier, comprises: an image printing system comprising an imaging surface on which a toner image is formed from the liquid developer, and transferring the toner image from the imaging surface to the print medium; and an air treatment system having a cleaning member which comprises: a holding member having a passage; and a particulate material which is capable of absorbing or adsorbing vapor of the liquid carrier and which is held in the passage with room for the particulate material to move in the passages.

BRIEF DESCRIPTION OF THE SEVERAL VIEWS OF THE DRAWINGS

The features and advantages of the electrophotographic printing apparatus according to the present invention over the proposed apparatus will be more clearly understood from the following description of the preferred embodiments of the present invention taken in conjunction with the accompanying drawings in which like reference numerals designate the same or similar elements or sections throughout the figures thereof and in which.

DETAILED DESCRIPTION OF THE INVENTION

Figure 1:
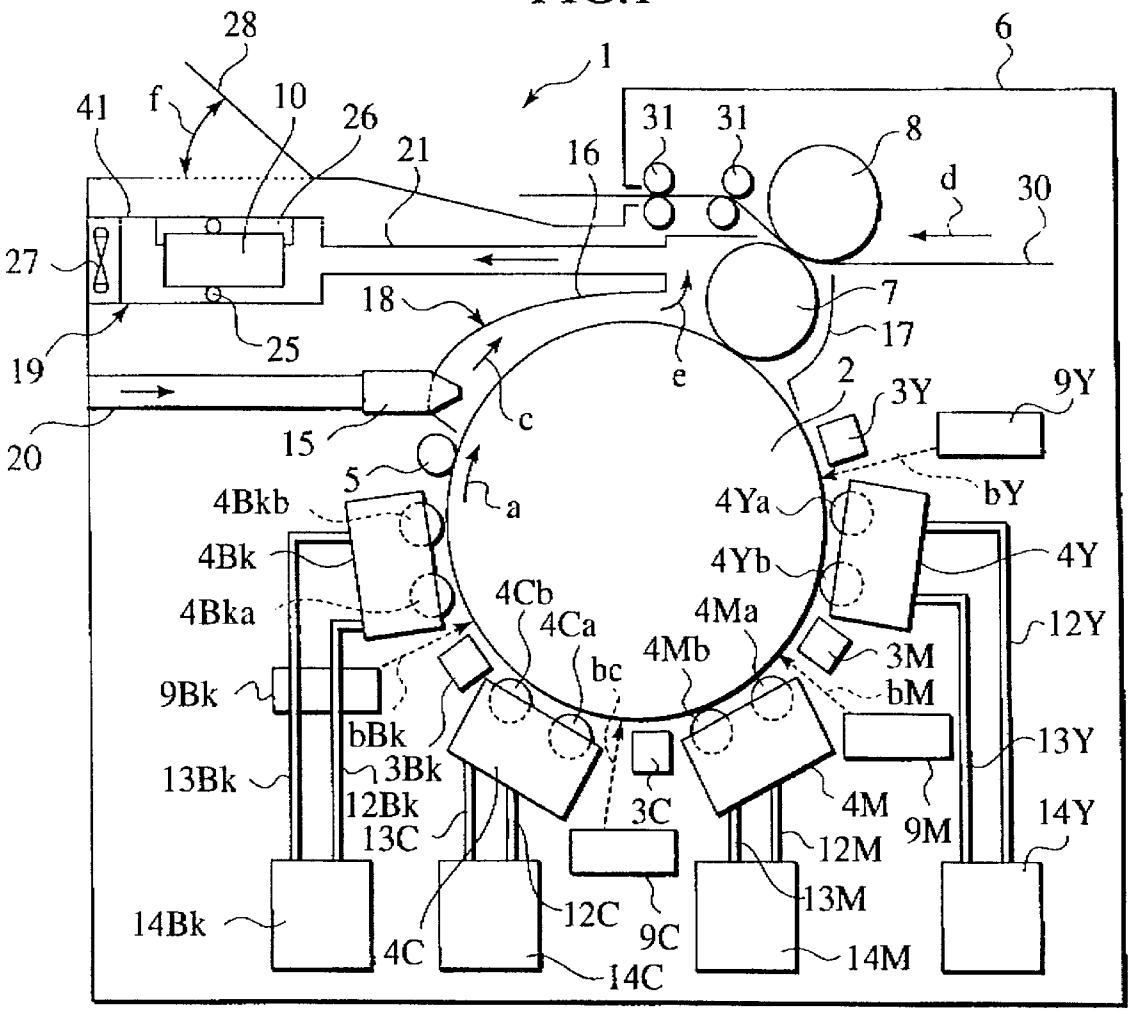
FIG. 1 is a schematic constructional view showing the first embodiment of the electrophotographic image formation apparatus equipped with an exhaust cleaning device according to the present invention.

Image formation by electrophotography using a liquid developer is attained by the steps of: generating an electrostatic latent image on a photosensitive layer by effecting light exposure, corresponding to an image to be formed, on the surface of a charged photosensitive layer and eliminating charge on the exposed part; developing the electrostatic latent image with a toner by feeding on the surface of the photosensitive layer a liquid developer which is prepared by dispersing a toner having electrostatic charge in a carrier composed of insulating liquid (organic solvent), namely, a developing solution; removing an unnecessary liquid carrier; and transferring the developed image to a print medium (recording medium such as paper, etc.) from the photosensitive layer. In the case of a multicolor electrophotography, all of these steps are repeated on each of four colors, yellow (Y), magenta (M), cyan (C) and black (Bk), or generation of an electrostatic latent image, development and removal of an unnecessary carrier are conducted on each color to form full color images on a photosensitive layer, then a transfer step is conducted.

In adsorption (or absorption) methods using a filter or a column filled with an adsorbent (absorbent), the effective period of the filter (or column) is limited in a time period until saturation of the adsorbent with a solvent. Accordingly, size reduction of the filter causes decrease in the maximum treatment capacity, leading directly to shortening of the life span of the filter. Therefore, decrease in size of the filter equipped to an image printing apparatus causes increase of the maintenance frequency of the apparatus. On the other hand, the actual treatment ability of the filter falls before the full saturation of the adsorbent and a necessity of filter exchange arises earlier. In view of the above, if the fall in the treatment ability of the filter before saturation of the adsorbent is suppressed, disadvantages in use of a compact filter are improved.

Moreover, in exhaust cleaning by a filter, if the filling density of the adsorbent is raised for enhancing the cleaning efficiency, the ventilation resistance of the column increases remarkably, causing decrease in treatment speed and increase in consumption energy.

In the present invention, a cleaning life and a ventilation resistance of the filter are improved in conducting exhaust purification by a compact filter of adsorption (or absorption) mode in an electrophotographic image printing apparatus.

Now, referring to the drawings, embodiments of the electrophotographic image printing apparatus and exhaust cleaning device thereof of the present invention will be illustrated in detail below. In the following descriptions, the same or equivalent members or parts are represented by the same marks and supposed to manifest the same actions, and repetitions of detailed descriptions are omitted.

FIG. 1 is a schematic constitutional view showing a first embodiment of the electrophotographic image formation apparatus equipped with an exhaust cleaning device according to the present invention.

As shown in FIG. 1, the electrophotographic image printing apparatus 1 are so constructed that full color images are formed on a photosensitive layer before being transferred to a recording medium, and comprises: a cylindrical photosensitive body 2 carrying on the peripheral surface thereof a photosensitive layer for forming an electrostatic latent image: electrification chargers 3Y, 3M, 3C and 3B*k* placed around the photosensitive body 2; developer units 4Y, 4M, 4C and 4B*k* placed around the photosensitive body 2 so that they are placed at the positions subsequent to the electrification chargers 3Y, 3M, 3C and 3B*k*, respectively, along the rotation direction of the photosensitive body 2; a contact squeezing roller 5 placed at the position following to the developer units 4B*k;* an intermediate transfer roller 7 circumscribed to the photosensitive body 2; a backup roller 8 pressed to the intermediate transfer roller 7 via a print medium 30 or recording medium such as paper; exposure apparatuses 9Y, 9M, 9C and 9B*k*; and a housing 6 covering these members. The developer units 4Y, 4M, 4C and 4B*k* are connected, respectively, to liquid developer feeding pipings 12Y, 12M, 12C and 12B*k* and liquid developer recovering pipings 13Y, 13M, 13C and 13B*k* correspondently, and the liquid developer feeding pipings and the developing liquid recovering pipings are connected to developing tanks 14Y, 14M, 14C and 14B*k*, respectively. The developing tank 14 is connected to a concentrated developing liquid feeding vessel not shown, and if necessary, concentrated developing liquid is fed to the developing tank 14. The developer units 4Y, 4M, 4C and 4B*k* have, respectively, developing rollers 4Y*a,* 4M*a,* 4C*a* and 4B*ka* and squeezes 4Y*b,* 4M*b,* 4C*b* and 4B*kb* in the form of roller, and they are so placed that a small clearance is formed between them and the photosensitive body 2. A blow nozzle 15 used for drying is placed at a position following to the above-mentioned contact squeezing roller 15, and air is fed to the blow nozzle 15 through an introduction piping 20 from out of the apparatus.

When the photosensitive body 2 rotates clockwise as shown by an arrow a in the figure, the electrostatic charger 3Y is operated and a photosensitive layer on the surface of the photosensitive body 2 is electrified uniformly. Laser or LED light corresponding to a yellow image is radiated from an exposure apparatus 9Y to the electrified photosensitive layer in a direction represented by an arrow bY, to form an electrostatic latent image for yellow image. Then, by rotation of the developing roller 4Y*a* of the developer unit 4Y toward the reverse direction to that of the photosensitive body 2, yellow developing liquid is fed to the photosensitive layer, and the electrified yellow toner particles move by electrophoresis to the electrostatic latent image, which cause development to form a yellow image on the photosensitive body 2. The squeeze 4Y*b* rotates toward the same rotational direction as that of the photosensitive body 2 (surfaces thereof move to reverse directions to one another, accordingly), and by its shearing force, most part of unnecessary carrier on the surface of the photosensitive body is removed.

Also, for magenta, cyan and black images, the same operations as described above are repeated by the electrostatic chargers 3M, 3C and 3B*k,* the exposure apparatuses 9M, 9C and 9B*k,* the developing rollers 4M*a,* 4C*a* and 4B*ka* and the squeezes 4M*b,* 4C*b* and 4B*kb,* and electrostatic latent images are generated by irradiation along arrows bM, bC and bBk directions. The carrier solvent remaining in the formed full color toner image is squeezed out by the pressure of the contact squeezing roller and further vaporized by air fed from the blow nozzle 15 for drying the toenr image. The blowing direction of the blow nozzle 15 is inclined from the radial direction of the photosensitive body, and air flows from the blow nozzle 15 along the surface of the photosensitive body toward the direction of an arrow c to the intermediate transfer roller 7. The toner image on the surface of the photosensitive body 2 is transferred to the intermediate transfer roller 7 having higher surface stickiness than that of the photosensitive body 2. This image is heated by the intermediate transfer roller 7 and transferred to a recording medium by a backup roller 8. The print medium 30 is carried from right to left as shown by an arrow d in the figure, and after printing, transported onto a paper tray (not shown) by a plurality of holding rollers 31.

The electrophotographic image printing apparatus 1 in FIG. 1 has a duct system for collecting a solvent vapor evaporated from the surface of the photosensitive body 2 by the blow nozzle 15 and feeding the vapor to a cleaning cartridge for exhaust purification. The duct system comprises a solvent recovering cover 18, recovering piping 21 and a fan (or pump) 27, and an exhaust flowing in the duct system passes through the cleaning cartridge of an exhaust cleaning device 19 located between the recovering piping 21 and the fan 27.

The solvent recovering cover 18 is a cover which is placed near the developed images and covers the images, and it is constructed of a dry room cover 16 which extends from the tip part of the blow nozzle 15 along the periphery of the photosensitive body 2 toward the intermediate transfer roller 7 to define a dry room between it and the photosensitive body 2, and of an intermediate transfer roller cover 17 which covers the periphery of the intermediate transfer roller so as to define a given space around the intermediate transfer roller 7. The above-mentioned solvent recovering cover 18 is constructed to be as airtight as possible between the photosensitive body 2, intermediate transfer roller 7 and backup roller 8, and the air blown from the blow nozzle 15 to the photosensitive body 2 flows along the surface of the photosensitive body in the directions of arrows c and e while vaporizing the carrier solvent on the photosensitive body, and the solvent is prevented from being diffused into other places of the apparatus.

Moreover, the intermediate transfer roller cover 17 of the solvent recovering cover 18 is connected to the exhaust cleaning device 19 via the recovering piping 21, and the exhaust containing the carrier solvent vaporized by air dry or heat evaporation is introduced to the cleaning cartridge 10 which is detachably installed to the exhaust cleaning device 19.

The exhaust cleaning device 19 comprises an outer sleeve 41 in the form of tube, which defines a cleanining room communicating with the above-mentioned recovering piping 21 and the exterior space of the apparatus, and the cleaning cartridge 10 in the form of cylinder, which is installed coaxially in the outer sleeve 41. The cleaning cartridge 10 has a treatment agent filled therein, which can adsorb or absorb a solvent (details of the cleaning cartridge 10 are described later). The exhaust from the recovering piping 21 is forcibly discharged out of the apparatus through the exhaust cleaning device 19 with the aid of the fan 27. A portion of The housing 6 has a portion constituting a door 28 which opens and closes along an arrow f, and the above-mentioned exhaust cleaning device 19 is located in the vicinity of the door 28. A part of the above-mentioned outer sleeve 41 is so formed as to constitute a door 26 which can open and close for enabling attachment and detachment of the above-mentioned cleaning cartridge 23. The door 26 may also be so formed as to have one end connected with the outer sleeve 41 in a hinge-wise manner. A rock mechanism using an elastic stoppage member and the like is provided to fix the door 26 and door 28 to the outer sleeve 41 and the housing 6, respectively, and a handle is formed for rendering the opening and closing operation easier. Further, the door 26 and the door 28 are equipped with a sealing structure for preventing air from leaking.

Opening the doors 28 and 26 and installing the cleaning cartridge 10 in the outer sleeve 41, the doors are closed, while a seal member 25 formed of an elastic material having solvent-resistance provide sealing between the outer sleeve 41 and the cleaning cartridge 10. The space defined as the cleaning room in the outer sleeve 41 is separated into two parts, the upstream part and the downstream part of the seal member 25. Therefore, an inflow port of the cleaning cartridge 10 is blocked from an exhaust port of the cleaning room. Therefore, the exhaust fed from the recovering piping 21 to the upstream part of the outer sleeve 41 flows surely through the cleaning cartridge 10, and the solvent is adsorbed or absorbed by a treatment agent in the cartridge before the exhaust is discharged out of the apparatus by the fan 27.

In accordance with the construction as described above, the user can exchange the cleaning cartridge easily and there are no necessity of limiting the volume of the cleaning device in view of dependence on maintenance service. Consequently, a space necessary for exhaust purification can be reduced.

Moreover, since the seal member is disposed on the peripheral portion of the cleaning cartridge, an airtight structure is surely formed when the doors are closed, whereby providing a secure structure allowing no leakage of the solvent. In this embodiment, an intake of air and an introduction of the solvent vapor generated during the process of drying and heat evaporation into the exhaust cleaning device can be conducted by one fan, and the system can be simply constituted. Therefore, improvement of reliability of an electrophotographic image printing apparatus and reduction of maintenance cost become possible. Hence, it should be noted that there is no prevention on installment of a fan or pump in an introducing piping 20 for promoting air feeding from the blow nozzle 15 and the like.

Figure 2:
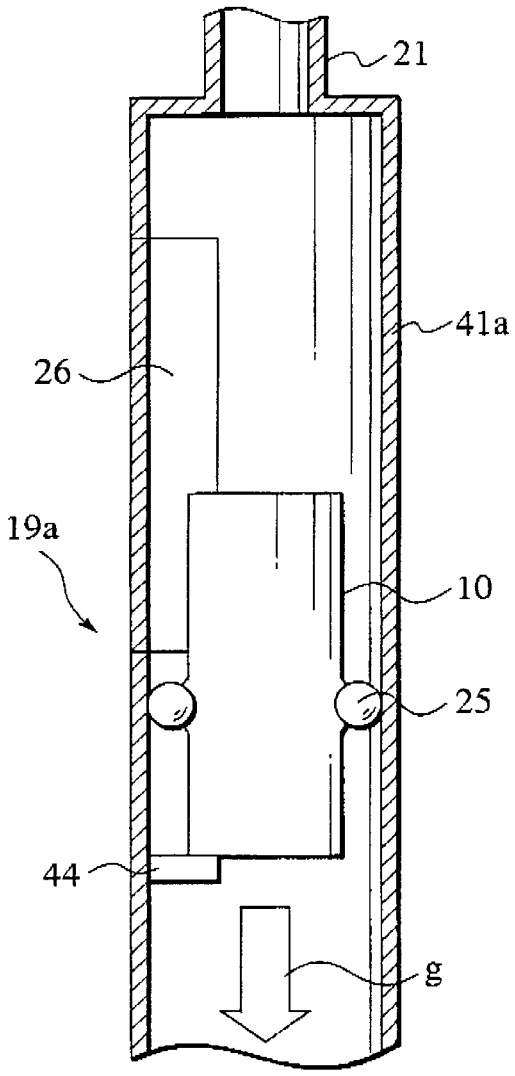
FIG. 2 is a schematic constructional view showing the second embodiment of the exhaust cleaning apparatus of the electrophotographic image printing apparatus of the present invention.

FIG. 2 is a schematic constructional view for illustrating a second embodiment of the exhaust cleaning device and it shows a section of an outer sleeve, wherein inside of the cleaning cartridge 10 is omitted. This exhaust cleaning device 19*a* differs from that of FIG. 1 in respect that the inner wall of the outer sleeve 41*a* has a stopper 44 which is provided for positioning the cleaning cartridge 10 while inserting the cleaning cartridge 10 into the outer sleeve 41. Moreover, a shallow groove is provided on the outer peripheral surface of the cartridge along the circumference thereof, and a seal member 25 in the form of ring, which is a different body from the cleaning cartridge 10, is fitted into the cleaning cartridge 10, so that the seal member 25 is positioned and fixed by the groove. With opening the door 26, the cleaning cartridge 10 equipped with the seal member 25 is insert in the outer sleeve 41*a* and pushed in the axial direction of the outer sleeve, whereby the seal member 25 moves on the inner wall surface of the outer sleeve 41*a* while sliding thereon. Then the end of the cleaning cartridge 10 abuts on the stopper 44 and the cleaning cartridge 10 is positioned by the stopper 44. In this state, the seal member 25 is disposed to stand off the door 26. Namely, since the seal member 25 is on the portion on which no door is provided, an airtight structure is easily securred by the seal member, and the vapor of carrier solvent passes surely through the cleaning cartridge. Thus, reliability of the exhaust cleaning treatment is enhanced to give an ideal exhaust cleaning mechanism.

As described above, in the exhaust cleaning device of an electrophotographic image printing apparatus constituted as shown in FIG. 2 realizes, positioning of the cleaning cartridge is surely conducted by a stopper member, and air tightness is enhanced by assured positioning of the seal member on the portion on which no door is provided, consequently, so that the solvent vapor passes assuredly through the cleaning cartridge. As a result, reliability of exhaust purification treatment can be enhanced to give an ideal exhaust cleaning device.

Figure 3:
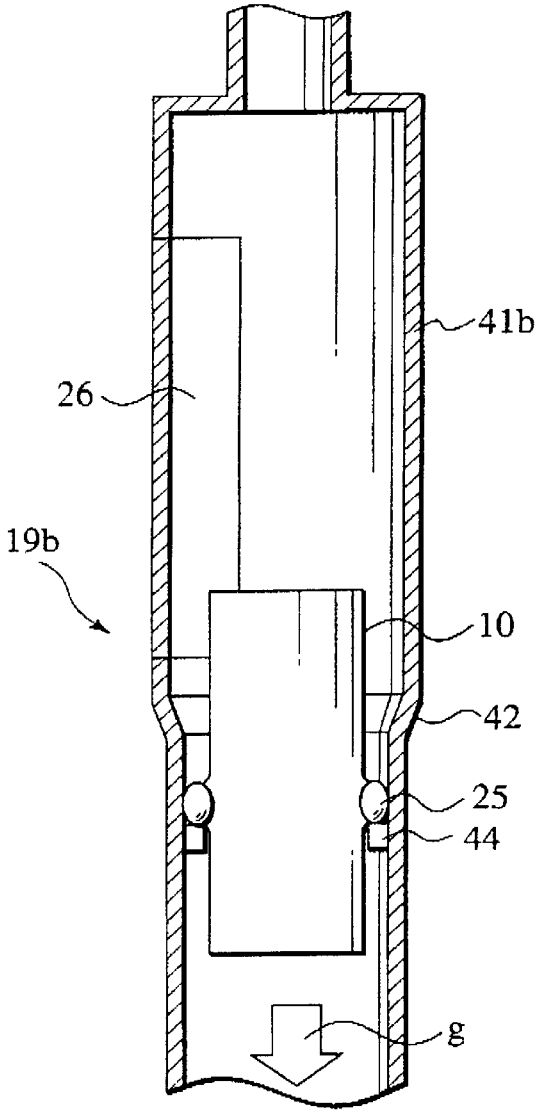
FIG. 3 is a schematic constructional view showing the third embodiment of the exhaust cleaning device of the present invention.

FIG. 3 is a schematic constructional view for illustrating the third embodiment of the exhaust cleaning device, and shows a section of an outer sleeve 41*b*. The outer sleeve 41*b* of this exhaust cleaning device 19*b* has an upstream portion having a larger diameter at the upstream side of the exhaust flow, a downstream paotion having a smaller diameter and a constriction part 42 connecting them. The door 26 is provided on the upstream portion of the outer sleeve 41*b* and the stopper 44 is provided on the downstream portion. This construction makes easier the installment of the cleaning cartridge 10 from the door 45 to reduce the user's troubles on exchange. It is also possible to modify this embodiment in such a manner that the constriction portion serves simultaneously as a stopper. For example, it is possibly defomed in such a manner that the constriction part is shortened (or omitted) to provide a substantially level shoulder (at least on the inner wall surface of an outer sleeve), and that the seal member 25 attached to the cleaning cartridge 10 is stopped by the shoulder. It is noted that positioning of the seal member 25 on the cleaning cartridge in this embodiment is given by two projections formed annularly on the periphery of the cartridge at a preset interval, and the seal member 25 is held between the projections. The projections may also be formed so as to constitute only a plural parts of the circumference, and for example, they may be provided in the form of arcs or dots arranged along the circumference.

As seen from the above, by constituting the exhaust cleaning device of the electrophotographic image printing apparatus so that the diameter of the outer sleeve at the portion on which the door is provided is larger than that of the portion to which the cleaning cartridge is supported with a seal as shown in FIG. 3, the cleaning cartridge can be easily set to the outer sleeve while air-tightness around the cleaning cartridge and certainty of air purification are posessed. Therefore, utilities for users are improved.

Figure 4:
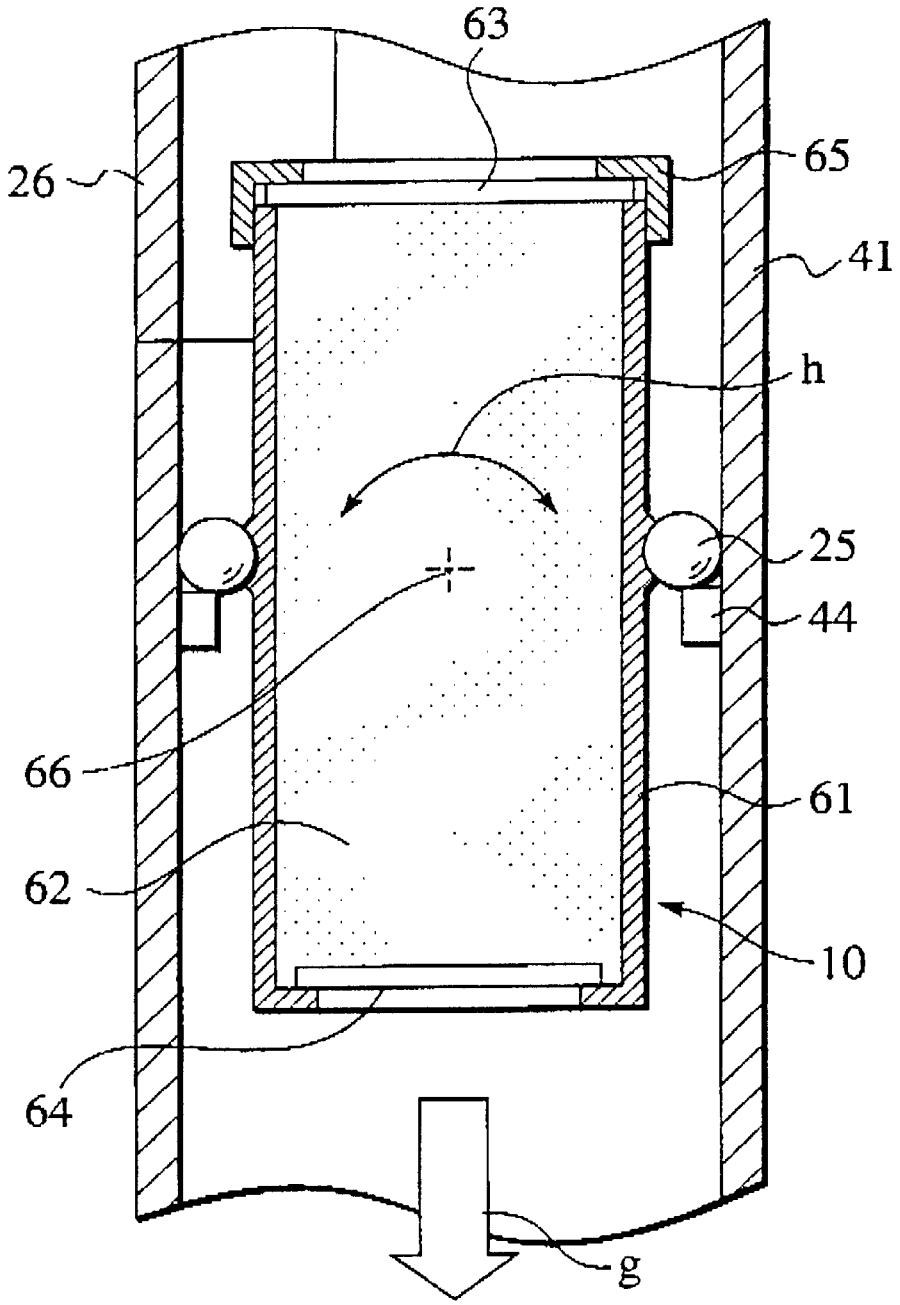
FIG. 4 is a schematic constructional view showing the first embodiment of the cleaning cartridge in the exhaust cleaning device of the present invention.

FIG. 4 is an enlarged sectional view for illustrating the construction of the cleaning cartridge according to the present invention. The cleaning cartridges shown in FIGS. 4 to 6 can be applied as the first to third embodiments to the cleaning cartridge of the exhaust cleaning device shown in FIGS. 1 to 3 described above.

In the first embodiment shown in FIG. 4, the cleaning cartridge 10 comprises: a tubular cartridge outer sleeve 61 having, on one end thereof, an annular flange extending inward in the radial direction; a treatment agent 6 accommodated in the cartridge outer sleeve 61; mesh members 63 and 64 in the form of disk; and a cartridge lid 65 having a circular opening. The mesh member 63 is slightly larger than the inner diameter of the cartridge outer sleeve 61, and the mesh member 64 is slightly larger than the inner diameter of the flange. The cleaning cartridge 10 shown in FIG. 4 is assembled as follows. First, the mesh member 64 is inserted into the cartridge outer sleeve 61 and it is stopped by the flange. Then the treatment agent 62 is supplied into the cargridge outer sleeve, and the open end of the cartridge outer sleeve 61 is covered with the mesh member 63 before the cartridge lid 65 is fitted on the cartridge outer sleeve. The treatment agent 62 is not particularly restricted, providing it is a material manifesting adsorbing or absorbing ability for the carrier solvent. As examples of the material having adsorbing ability, adsorbents such as activated carbon, metal oxide and the like are specifically listed, and it is preferred to use a porous material having a large surface area. These adsorbent materials are possibly applied in the form of: a broken powder thereof; a filter having a porous structure such as a honeycomb structure and the like, and produced by molding the powdered paritcles thereof by pressing, sintering or fixing with use of a binder and the like; or a filter produced by allowing the adsorbent to be supported and fixed on a ceramic material, and the like. As those having an absorbing ability, absorbing agents for an acid, alkali aqueous solution and the like are listed, and they can be used in the form of gel beads, and the like. Activated carbon has an extremely high adsorbing ability, and is preferable also from the standpoint of recycle since regeneration of the recovered adsorbent and recovering of the carrier solvent can be conducted easily by heating. Therefore, activated carbon is particularly preferable to be used as the treatment agent. In FIG. 4, the cleaning cartridge 10 is so installed as to give a flow of the exhaust from the cartridge lid 65 to the flange in the direction depicted by an arrow g. However, the reverse installation may also be applicable.

In the case of using a particulate treatment agent, if the cleaning cartridge 10 having above-described construction undergoes vibration power given from outside, movements such as oscillation, rotation, displacement and the like occur on the treatment agent particles inside the cartridge. In accordance with this, the parts of particles which easily adsorb or absorb the vapor of carrier solvent (namely, the parts locating on the side facing against the exhaust flow)

change frequently, causing uniform adsorption or absorption on the whole particle surface. Therefore, fall of the treating ability of the treatment agent is delayed and the efficiency in adsorption or absorption is improved, so that an elongated life span of the exhaust cleanining device is possibly realized. An electrophotographic image printing apparatus usually uses a motor for driving the photosensitive body, etc., and the vibration generated on it is transmitted to each part of the apparatus. In this connection, it is preferred for stabilizing vibration of the cleaning cartridge to construct the cleaning cartridge such that natural frequency of the cleaning cartridge corresponds to a frequency that resonance is caused with the vibration which is generated by driving the motor. In the case of supplying vibration energy by means of an excitation device or the like to move the treatment agent particles, such vibration as has a frequency that resonance is possibly caused is preferably applied. In this case, it is preferable to use a particulate treatment agent having a particle form of sphere or close to sphere. For example, an activated carbon material of spherical particles having a particle size of about 0.5 to 3 mm is suitably used.

In FIG. 4, the cleaning cartridge 10 is supported by a seal member 25 which is positioned by two annular projections on the circumference. Therefore, if vibration energy along the radial direction is applied to the cleaning cartridge by an excitation apparatus (not shown), the cleaning cartridge 10 tends to rotationally oscillate as shown by an arrow h around the rotational center 66 which is on a cross point of a plane along the radiation direction including the seal member 25 fixing the cartridge and the central axis of the cleaning cartridge 10. If the gravity center of the cleaning cartridge is on the rotational center 66, vibration of the cleaning cartridge is more stabilized.

As described above, when the cleaning cartridge of an electrophotographic image printing apparatus is constituted as shown in FIG. 4, oscillation of the cartridge is caused by resonance with vibration from the driving part of the electrophotographic image printing apparatus or vibration applied from the outside, and the treatment agent particles inside the cartridge are moved. Consequently, it is possible to frequently shift the parts of the treatment agent particles which can easily adsorb or absorb the solvent vapor. In accordance with this, the whole surface of the treatment agent can be uniformly used for adsorbing or absorbing and the treatment ability of the treatment agent can be used sufficiently. As a result, an exhaust purification system having a longer life can be realized.

Figure 5:
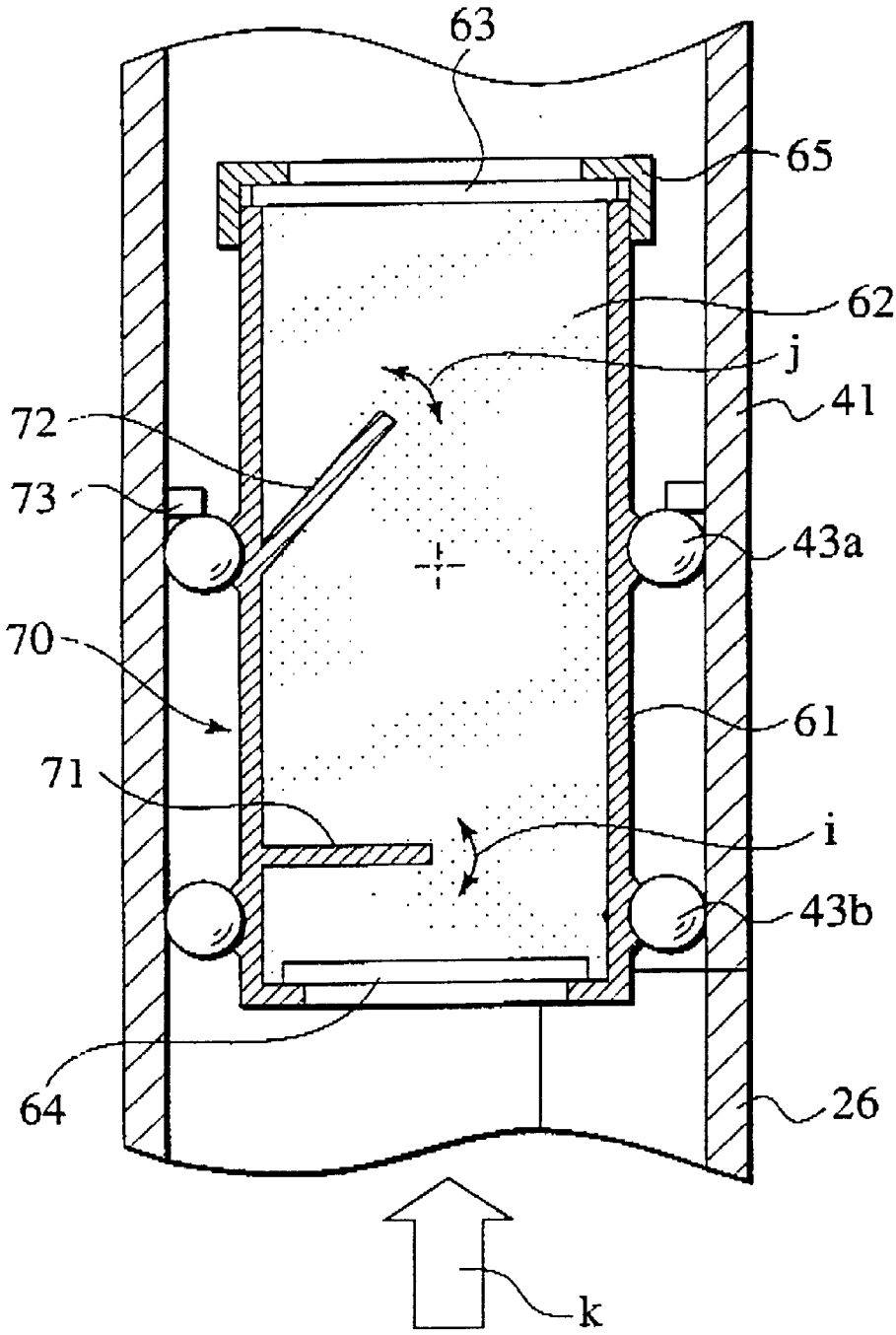
FIG. 5 is a schematic constructional view showing the second embodiment of the cleaning cartridge of the present invention.

In the second embodiment of the cartridge shown in FIG. 5, vibration pieces 71 and 72 are provided on the inner bore surface of the cleaning cartridge 70 for promoting movement of the particles of treatment agent. The form of the vibration piece 71 and vibration piece 72 may be any form such as rod, plate and the like, and they may advantageously be fomed in such dimensions and shape as to have a natural frequency that resonance is caused at the frequency of driving vibration of the electrophotographic image printing apparatus. The vibration piece 71 extends to the radial direction and reciprocates as shown by an arrow i due to vibration energy supplied by an excitation apparatus (not shown) from the outside. On the other hand, the vibration piece 72 extending inward is inclined toward the cartridge lid 65 from the radial direction, and reciprocates as shown by an arrow j. Moreover, the cleaning cartridge 70 are supported by two seal members 43*a* and 43*b* each of which is positioned, respectively, by a pair of annular projections on the periphery of the cartridge. In this construction, rotational reciprocation of the cleaning cartridge 10 around the rotational center 66 as shown in FIG. 4 is suppressed. Reciprocation of the vibration piece 72 causes movement of the treatment agent particles in the axial direction of the cleaning cartridge 70. The reciprocation of the vibration pieces 71 and 72 possibly produces local migration of the treatment agent particles, and the degree of stirring the treatment agent 62 in the cleaning cartridge is higher as compared with the embodiment in FIG. 4. Therefore, uniform adsorption or absorption on the whole surface of the treatment agent is promoted.

In the above embodiment, the exhaust flows in the cleaning cartridge 70 installed in the outer sleeve 41 from the mesh member 64 toward the mesh member 63 in the direction shown by an arrow k. The cleaning cartridge 70 is installed at the downstream side of the exhaust flow relative to the door 26 of the outer sleeve 41. However, it is also possible to modify the exhaust cleaning device and install the cleaning cartridge 70 at the upstream side of the exhaust flow relative to the door 26. In this case, the stopper for positioning the cleaning cartridge 70 is provided upstream relative to the door 26.

As described above, in the construction of the cleaning cartridge of the electrophotographic image printing apparatus as shown in FIG. 5, the treatment agent can be continuously stirred by vibration pieces provided inside, and the treatment ability of the treatment agent can be used sufficiently. Consequently, an exhaust purification system having a longer life can be realized.

Figure 6:
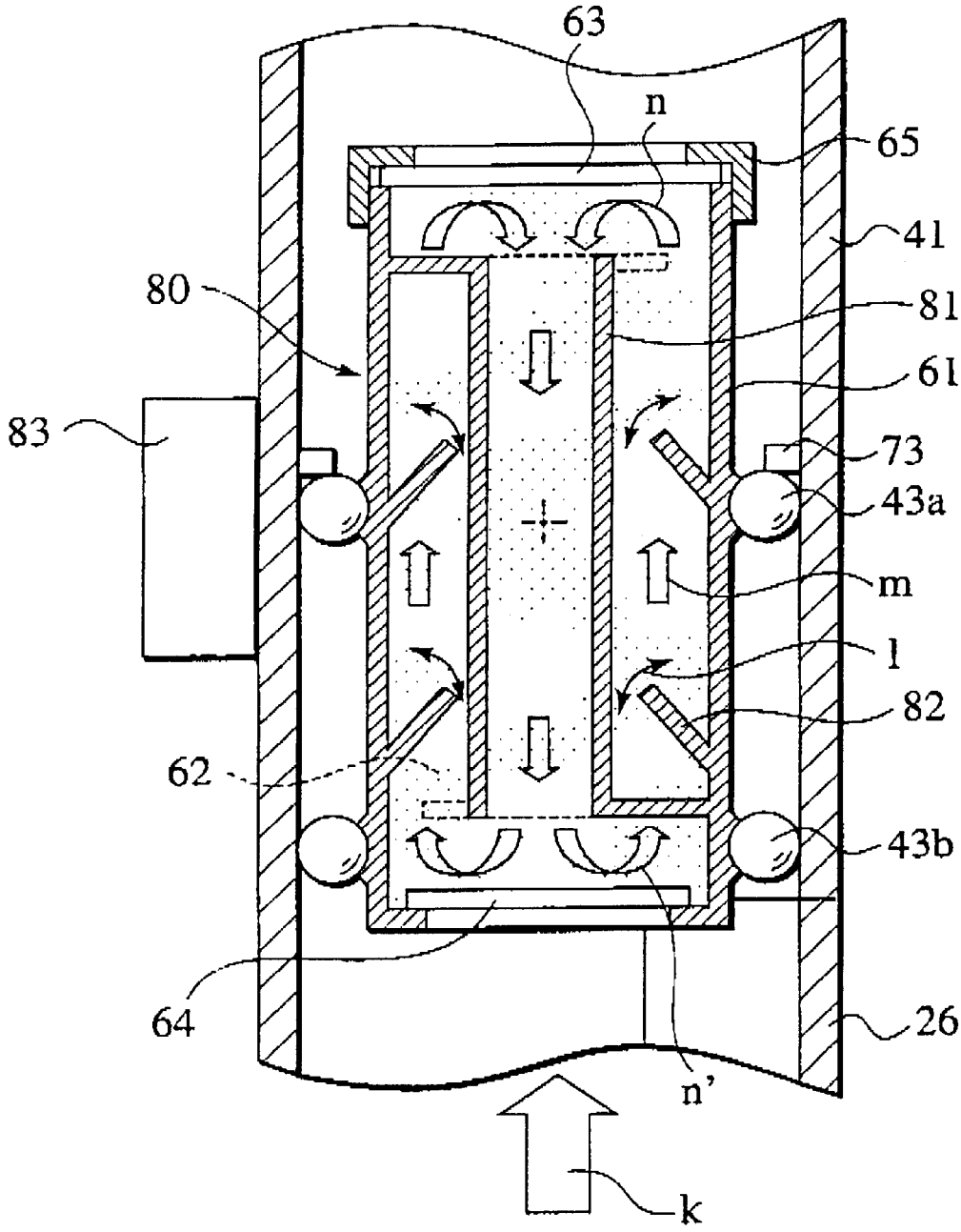
FIG. 6 is a schematic constructional view showing the third embodiment of the cleaning cartridge of the present invention.

FIG. 6 shows the third embodiment of the cleaning cartridge. This cleaning cartridge 80 comprises an inner sleeve 81 supported coaxially in the cartridge outer sleeve 61, and a plurality of vibration pieces 82 which extend inward from the inner bore surface of the outer sleeve 61 of the cleaning cartridge 80 while they are inclined toward the cartridge lid 65 from the radiation directions. The inner sleeve 81 is connected and fixed to the cartridge outer sleeve 61 at each of both ends thereof, respectively, by three supporting pieces extending in the radial directions with intervals of 120 degrees therebetween.

In the cartridge having the above constitution, when the vibration piece 82 is vibrated positively by an excitation apparatus 83, it reciprocates as shown by an arrow l in the drawing, and this reciprocal motion forces the treatment agent 62 in the cleaning cartridge 80 to move in the direction of an arrow m in the space outside of the inner sleeve 81. As a result, the treatment agent 62 circulates from the outside to the inside of the inner sleeve 81 and from the inside to the outside thereof as shown by arrows n and n', respectively. The exhaust passes from the mesh member 64 to the mesh member 63 in the direction of an arrow k.

In the embodiment of FIG. 6, the treatment agent 62 moves parallel to the axial direction of the cleaning cartridge in the spaces inside and outside of the inner sleeves 81. However, if a guide in the form of spiral is provided on the inner bore surface of the cartridge outer sleeve 61 or on the outer surface of the inner sleeve 81, the treatment agent 62 moves spirally along that guide through the space outside of the inner sleeve 81. Likewise, such spiral movement can be realized also by providing a similar spiral guide on the inner bore surface of the inner sleeve 81. In accordance with the above construction, uniformity of adsorption or absorption can be further increased, and efficiency of the cleaning cartridge can be further improved. Moreover, it is also possible to change the provision of the stopper 73 so that the cleaning cartridge 80 is located upstream relative to the door 26.

In accordance with the above construction of the cleaning cartridge of an electrophotographic image printing apparatus as shown in FIG. 6, the treatment agent in the cleaning cartridge is possibly circulated, using positive vibration provided by an excitation device and a vibration piece. Consequently, efficient exhaust treatment can be performed by the adsorption or absorption uniformly exhibited on the whole surface. Therefore, it is possible to elongate the life span of the exhaust purification system and further reduce the size of the apparatus.

Small distortion of the cartridge may also be caused by its vibration which is generated by feeding vibration energy from an excitation apparatus, corresponding to the vibration wave. However, even this phenomenon is also effective for moving the particles of the treatment agent inside the cartridge.

As described above, in the above-mentioned electrophotographic image printing apparatus, it is possible to reduce the volume of an exhaust treated to a small amount and increase efficiency of the exhaust cleaning treatment, by collecting the exhaust containing the vapor of carrier solvent and suppressing diffusion thereof with use of a cover. Therefore, size reduction of the space necessary for exhaust cleaning can be further progressed. Moreover, easy exchange of the treatment agent makes unnecessary the maintenance performed for every exchange, and reduction in the treatment volume of the exhaust purification system is permitted. Consequently, the size of the exhaust purification system can be reduced. Further, by improving adsorption or absorption efficiency of a treating agent, size reduction of the exhaust purification system and certainty of purification treatment can be realized.

Figure 7:
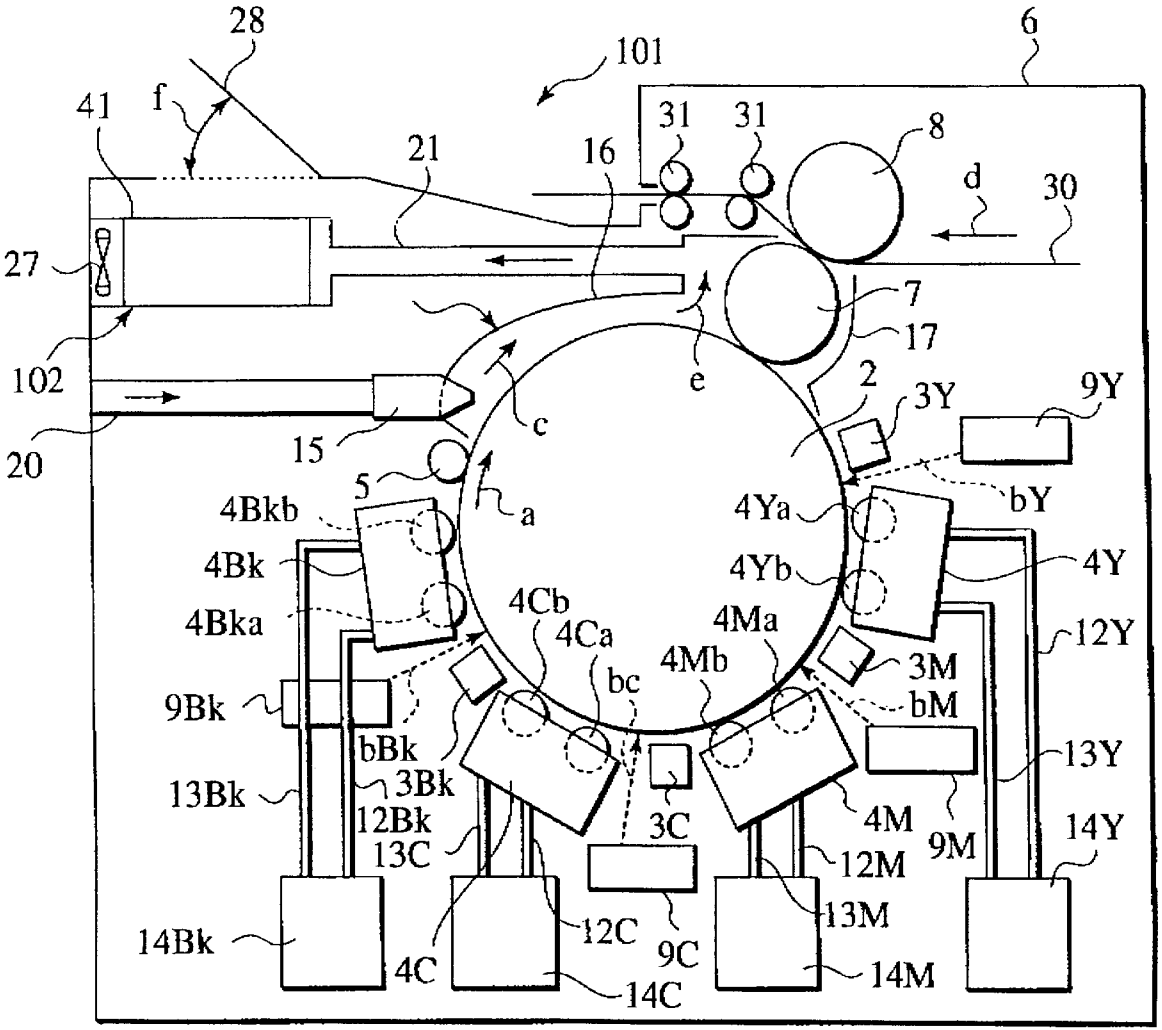
FIG. 7 is a schematic constructional view showing the second embodiment of the electrophotographic image printing apparatus equipped with an exhaust cleaning device of the present invention.

FIG. 7 is a schematic constructional view showing a second embodiment of the electrophotographic image printing apparatus having the exhaust cleaning device of the present invention.

The electrophotographic image printing apparatus 101 in FIG. 7 comprises an exhaust cleaning device 102 in which ventilation resistance on the exhaust purification is small, and the exhaust which flows in the solvent recovering cover 18 and the recovering piping 21 passes through an exhaust cleaning device 102 before it is discharged.

Figure 8:
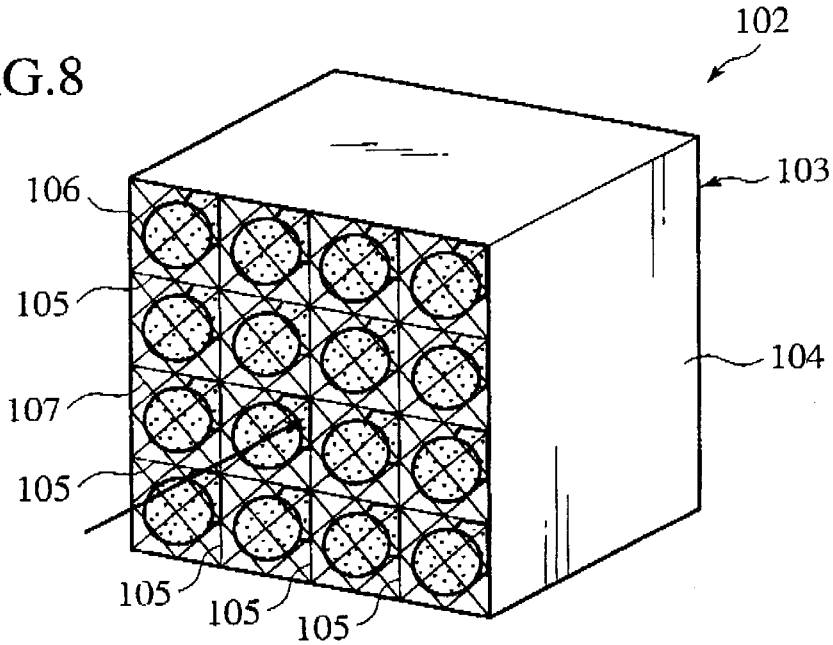
FIG. 8 is a perspective view showing the first embodiment of the exhaust cleaning device of the electrophotographic image printing apparatus of FIG. 7.

The exhaust cleaning device 102 comprises: a holding member 103 which has a case 104 having an exhaust inlet and an exhaust outlet on a pair of opposite ends thereof and inner partition member 105; and a particulate adsorbent 106, as shown in FIG. 8. The inner space of the case 104 is separated by the inner partition member 105 into a plurality of columnar flow passages in rows which are uniformly arranged in parallel to the direction x of the exhaust flow fed from the recovering piping 21, and particles of the adsorbent 106 are held and arranged in lines in the columnar flow passages. The holding member 103 also has a pair of meshes 107 in the form of lattice, covering the exhaust inlet and the exhaust outlet on both ends of the housing 104 for preventing the adsorbent 106 from escaping from the housing 104. Each of the meshes 107 is formed by using a resin having solvent resistance, a fibrous material, a metal wire or the like. The exhaust entering from the exhaust inlet flows along the inner partition member 105 while contacting with the adsorbent 106, before it is discharged. As a result, the exhaust is purified efficiently while undergoing only small ventilation resistance through the exhaust cleaning device 102.

The particulate adsorbent 106 comprises particles which are formed of a material exhibiting high adsorbing property for the vapor of carrier solvent, or a material having chemical absorbing property, such as activated carbon, metal oxides and the like. As examples thereof, coconut shell activated carbon and other ground activated carbons, those obtained by molding a powder of activated carbon into coarse particles and the like are illustrated. A particulate adsorbent 106 having such size as to make a clearance between it and the inner partition member 105 is suitably used so that there is provided room for the adsorbent to move in the columnar flow passage. For example, in the case of an adsorbent in the form of sphere, size of the adsorbent, height of the columnar flow passage and width thereof are so selected that the diameter of the adsorbent is smaller than that of the sphere inscribing in the columnar flow passage, and the amount of the adsorbent loaded is so controlled that the product of the number of the adsorbent particles loaded in one columnar flow passage and the diameter of the adsorbent is smaller than the length of the columnar flow passage along the longitudinal direction or the folow direction x. Therefore, the adsorbent 106 moves slightly in the columnar flow passage by weak force such as vibration or the like, and the parts of the adsorbent particles facing the exhaust are changed by the slightl movement of the adsorbent. Therefore, it is possible to suppress locally biased use of the surface of the adsorbent. Consequently, deterioration in efficiency of adsorbing the solvent is delayed, and the life span of the exhaust cleaning device 102 is elongated. If the adsorbent is in the form of sphere, movement of particles is smooth and the whole surface of the adsorbent can be allowed to contact uniformly with an exhaust. Consequently, adsorption efficiency is maintained for a long time. Slight movement of the adsorbent 106 is possible even if a means for positively imparting force such as vibration and the like is not necessarily provided. For example, if the columnar flow passages are slightly inclined so that the exhaust flow is directed slightly upward, the adsorbent moves by change of exhaust pressure due to flowing and stoppage of the exhaust. It is also possible to utilize slight reciprocation due to actuation of a motor in the image formation system.

In FIG. 7, the exhaust cleaning device 102 is directly connected to the recovering piping 21 and the fan 27. However, if the exhaust cleaning device 102 of FIG. 8 is fitted into the tubular outer sleeves 61 of FIG. 4 and used as the cleaning cartridge 10, it is more advantageous in that the adsorbent is easily exchanged. Moreover, if the inner partition member 105 is installed detachably from the case 104, the adsorbent can be easily removed from the case for recovering the adsorbent. The recovered adsorbent can be recycled by removing the solvent by heat treatment, etc.

In the exhaust cleaning device 102 of FIG. 8, the form of the columnar flow passage is square pole, and the form of a section vertical to the longitudinal direction is square. However, the form of the flow passage is not restricted to this shape, and various straight elongated shapes, e.g. polygonal poles such as a trigonal pole, a hexagonal pole, an octagonal pole, a dodecagonal pole and the like, cylinders, elliptic cylinders and the like may be permissible. In an exhaust cleaning device of honeycomb structure in which the form of the columnar flow passages is orthohexagonal pole, utilization efficiency of the inside space of the case and contacting efficiency between the adsorbent and the exhaust are particularly high. Moreover, all columnar flow passages does not necessarily have the same shape, and a plurality of different columnar shapes may also be combined to use for the folow passages.

Figure 9A:
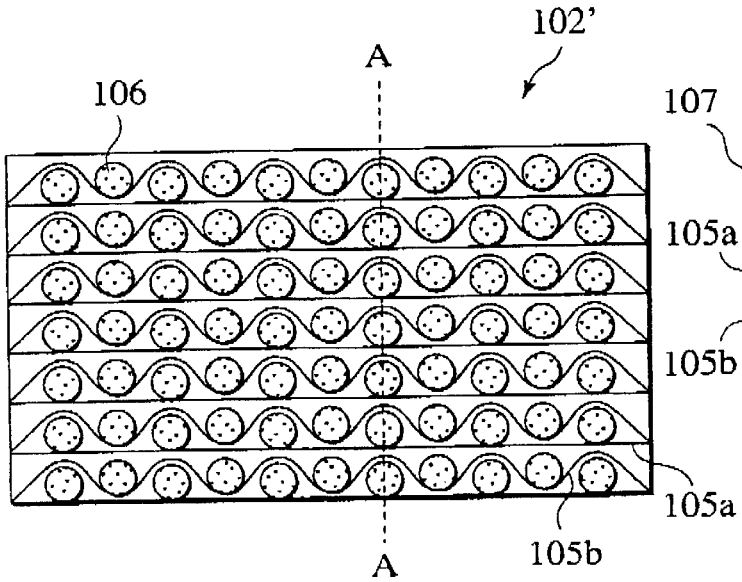
FIG. 9A is a sectional view showing the second embodiment of the exhaust cleaning apparatus of the electrophotographic image printing apparatus of FIG. 7 taken along with the line B—B in FIG. 9B.
Figure 9B:
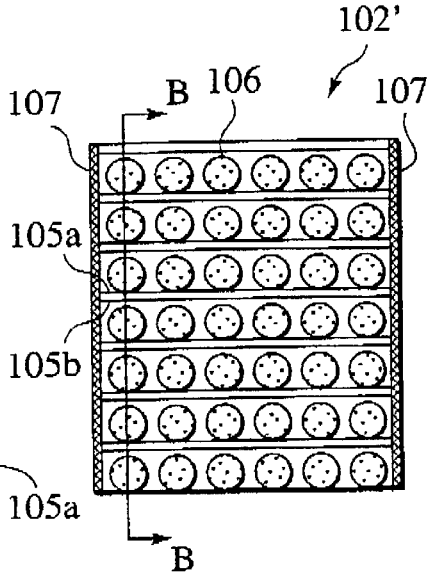
FIG. 9B is a sectional view of the exhaust cleaning device taken along with the line A—A in FIG. 9A.

If the inner partition member 105 and/or the case 104 of the holding member of the exhaust cleaning device 102 are formed of materials having adsorbing property, purification of the exhaust is conducted by both of the inner partition member 105 and/or the case 104 and the loaded particulate adsorbent 106. Consequently, this embodiment is quite effective. Such holding member 103 can be produced using a sheet of thin-layer activated carbon. For example, an exhaust cleaning device 102' having a shape of laminated corrugated paper as shown in FIGS. 9A and 9B is obtained by making inner partition walls 105*a* and 105*b* with use of an activated carbon sheet in the form of flat plate and an activated carbon sheet mold-processed into a wave form. Alternatively, a sheet of non-woven fabric made of activated carbon fiber or a hard cloth into which an activated carbon powder is woven may be used for the inner partition walls. The upper limit in absorption amount of the carrier vapor is about 10 to 50% of the total weight of activated carbon, and if the absorption amount approximates the upper limit, it becomes difficult to maintain the carrier vapor concentration of the treated exhaust at 10 ppm or less. Therefore, the life span of the exhaust cleaning device 102 is extended by forming an inner partition member and a case with activated carbon.

It is also possible to use an assmbly of a plurality of holding members as described above, which can be assembled by connecting the holding members in series or parallel. In this case, if a plurality of cases of which the length along the exhaust flow direction x is short are connected in series via meshes 107, such a series of columnar flow passages is screened into a plurality of portions by the meshes. Consequently, the movements of adsorbent particles are uniformed in the whole of a seriese of flow passages.

The exhaust cleaning device as shown in FIGS. 8 and 9 has small ventilation resistance, and the concentration of the carrier solvent in the exhaust can be decreased significantly by the exhaust cleaning device. Consequently, if the exhaust cleaning device is used together with a cooling condenser or a gas separation membrane and the like, a purification system which can exhibit high purification ability at high exhaust treatment speed is constituted.

EXAMPLE

Inner partition walls and a case were so constituted as to provide columnar flow passages in the form of laminated corrugated paper as shown in FIGS. 9A and 9B, using an activated carbon sheet in the form of flat plate and an activated carbon sheet in the form of wave, each having a thickness of 0.2 mm. The length of the case along the longitudinal direction was 20 mm, the size of a section vertical to the longitudinal direction was 120 mm square, and the content of activated carbon was 54 mg/cm$^3$. When supposing the shape of the section of the columnar flow passages was triangle, the base of the triangle was 5 mm and the height was 2 mm. Activated carbon particles in the form of sphere having a diameter of 1 mm were loaded in the columnar flow passages so that the loading ratio was about 50% based on the volume of the holding member, and meshes into which metal fine wires had been woven were used to cover the exhaust inlet and the exhaust outlet, to make an exhaust cleaning device.

When an exhaust containing a vapor of a carrier solvent of a liquid developer in a concentration of 500 to 1000 ppm was passed through the above-mentioned exhaust cleaning device, the concentration of the carrier vapor in the exhaust after passing was reduced to several to 10 ppm.

In the present invention, purification of an exhaust can be conducted by a cleaning cartridge which can be simply exchanged by users. The part in which exhaust purification is conducted gives high air-tightness, and leaking of the vaporized solvent can be prevented. Moreover, vaporization of the solvent, transportation of the vaporized solvent to the purification system, and discharge of the exhaust can be conducted by a single fan or pump, and that is effective for simplification of the system. Furthermore, improvement of reliability of an electrophotographic image printing apparatus and reduction of maintenance cost become possible. The concentration of the carrier vapor in the exhaust can be extremely reduced.

This application claims benefit of priority under 35 U.S.C. § 119 to Japanese Patent Application No. 2000-278504, filed on Sep. 13, 2000 and Japanese Patent Application No. 2000-293617, filed on September 27, the entire contents of which are incorporated by reference herein.

It must be understood that the invention is in no way limited to the above embodiments and that many changes may be brought about therein without departing from the scope of the invention as defined by the appended claims.

What is claimed is:

1. An electrophotographic printing apparatus for printing an image on a print medium with use of a liquid developer which contains a liquid carrier and a toner being dispersed in the liquid carrier, comprising:

an image printing system comprising an imaging surface on which a toner image is formed from the liquid developer, and transferring the toner image from the imaging surface to the print medium; and an air treatment system having a cleaning member which comprises: a holding member having an outer case and an inner partition member which is provided in the outer case to form a plurality of passages in parallel rows; and a particulate material which is capable of absorbing or adsorbing vapor of the liquid carrier and which is held in the plurality of passages.

2. The electrophotographic printing apparatus of claim 1, wherein the particulate material includes particles of active carbon.

3. The electrophotographic printing apparatus of claim 1, wherein the particulate material is charged in the passages with room for the particulate material to move in the plurality of passages.

4. The electrophotographic printing apparatus of claim 1, wherein the holding member has a honeycomb shape.

5. The electrophotographic printing apparatus of claim 1, wherein the holding member comprises a plurality of parallel walls and a plurality of reciprocally bent walls alternately disposed between the plurality of parallel walls to have a corrugated-paper shape.

6. The electrophotographic printing apparatus of claim 1, wherein the holding member is capable of absorbing or adsorbing vapor of the liquid carrier.

7. The electrophotographic printing apparatus of claim 6, wherein at least a part of the holding member is composed of a material which contains active carbon.

8. The electrophotographic printing apparatus of claim 1, wherein the plurality of passages have a straight elongated shape, and the particulate material in each of the plurality of passages is held substantially in a line.

9. The electrophotographic printing apparatus of claim 1, wherein the plurality of passages have a columnar shape.

10. The electrophotographic printing apparatus of claim 1, wherein the particulate material has dimensions which are smaller than those in cross sections of the plurality of passages, to have room to move in the plurality of passages.

11. The electrophotographic printing apparatus of claim 1, wherein the air treatment system comprises:

a vapor directing system which directs air containing vapor of the liquid carrier vaporizing from the imaging surface, to the cleaning member, whereby the air flows through the plurality of passage of the holding member.

12. The electrophotographic printing apparatus of claim 11, wherein the particulate material is held in the plurality of passages with room for the particulate material to move in the passage, and the particulate material moves as the air flows.

13. The electrophotographic printing apparatus of claim 11, wherein the vapor directing system has a conduit having a pair of ends, one of which collects the air containing vapor of the liquid carrier, and the other of which is connected to the cleaning member to provide the air to the plurality of passage.

14. The electrophotographic printing apparatus of claim 1, wherein the inner partition member is removably fitted in the outer case.

15. The electrophotographic printing apparatus of claim 14, wherein the inner partition member is composed of a material which is capable of absorbing or adsorbing vapor of the liquid carrier.

16. The electrophotographic printing apparatus of claim 1, wherein the plurality of passages are uniformly disposed in rows.

17. The electrophotographic printing apparatus of claim 1, wherein the cleaning member comprises a pair of meshes which cover both ends of the plurality of passages to prevent the particulate material from escaping from the plurality of passages.

18. The electrophotographic printing apparatus of claim 1, wherein the image printing system comprises a blowing nozzle which blows air and evaporates the liquid carrier contained in the toner image on the imaging surface to dry the toner image.

19. An electrophotographic printing apparatus for printing an image on a print medium with use of a liquid developer which contains a liquid carrier and a toner being dispersed in the liquid carrier, comprising:

an image printing system comprising an imaging surface on which a toner image is formed from the liquid developer, and transferring the toner image from the imaging surface to the print medium;

an air treatment system having a cleaning member which comprises: a holding member having a passage; and a particulate material which is capable of absorbing or adsorbing vapor of the liquid carrier and which is held in the passage with room for the particulate material to move in the passages; and a vapor directing system which directs air containing vapor of the liquid carrier vaporizing from the imaging surface to the cleaning member, whereby the air flows through the passage of the holding member to move the particulate material in the passage.

20. The electrophotographic printing apparatus of claim 19, wherein the air treatment system has a seal member which supports the cleaning member so as to allow the cleaning member to oscillate by vibration provided from outside of the cleaning member.

21. The electrophotographic printing apparatus of claim 19, wherein the cleaning member further comprises a vibration piece which is configured to promote the particulate material to move by vibration which is provide from outside of the cleaning member.

22. The electrophotographic printing apparatus of claim 19, wherein the cleaning member further comprises an inner sleeve separating the passage into an inner passage and an outer passage to allow the particulate material to circulate the inner passage and the outer passage.

* * * * *